United States Patent [19]

Stone

[11] Patent Number: 5,035,521

[45] Date of Patent: Jul. 30, 1991

[54] ENVELOPE PRINTING MECHANISM

[75] Inventor: Bernard D. Stone, Maple Glen, Pa.

[73] Assignee: Addressease, Inc., Maple Glen, Pa.

[21] Appl. No.: 475,783

[22] Filed: Feb. 6, 1990

[51] Int. Cl.[5] ..... B41G 3/00; B41J 5/30

[52] U.S. Cl. ..... 400/17; 400/25; 400/29; 400/30; 400/34; 400/68; 400/645; 400/691

[58] Field of Search ..... 400/16–77, 400/23, 25, 29–30, 33–34, 44, 48, 645, 188, 63, 691, 67, 68, 62; 102/57, 474

[56] References Cited

U.S. PATENT DOCUMENTS

| | | | |
|---|---|---|---|
| 3,923,135 | 12/1975 | Holman et al. | 400/23 |
| 4,031,519 | 6/1977 | Findley | 400/63 |
| 4,575,267 | 3/1986 | Brull | 400/656 |
| 4,624,588 | 11/1986 | Bivin | 400/636 |
| 4,744,296 | 5/1988 | Edwards et al. | 400/48 |
| 4,818,126 | 4/1989 | Brooks et al. | 400/656 |
| 4,828,416 | 5/1989 | Pensavecchia | 400/691 |
| 4,846,594 | 7/1989 | Riskin | 400/188 |

FOREIGN PATENT DOCUMENTS

| | | | |
|---|---|---|---|
| 3211451 | 10/1982 | Fed. Rep. of Germany | 400/25 |

OTHER PUBLICATIONS

Computer Reseller News, Nov. 20, 1989, p. 112.

*Primary Examiner*—Eugene H. Eickholt
*Attorney, Agent, or Firm*—Howson & Howson

[57] ABSTRACT

The elements of a printing mechanism, including a platen, print head and drive motors, are constructed and arranged to provide a clearance permitting an envelope to remain entirely in a flat condition in a plane tangent to the platen at the location of the printing line while the envelope is being printed by the print head. The housing of the printing mechanism is constructed with specially configured slots. First and second opposite end walls of the housing, and a third wall, extending from one end wall to the other, provide at least partial coverage of the print head and platen. The third wall has a slot extending from one end wall to the other, the slot being arranged to receive an envelope and to allow the envelope to be inserted in a flat condition between the print head and the platen. The end walls have parallel slots, meeting and continuous with the slot of the third wall. The parallel slots of the end walls are aligned with the plane which is tangent to the platen at the location of the printing line, so that the envelope being printed can extend outwardly from the housing through all three slots. The printing accommodates envelopes in a wide range of sizes.

8 Claims, 7 Drawing Sheets

ENVELOPE PRINTING MECHANISM

BRIEF SUMMARY OF THE INVENTION

This invention relates to printers, and more specifically to a printing mechanism adapted to imprint destination addresses on mailing envelopes.

With the increasing use of word processors and personal computers programmed to perform word processing functions, a need has arisen for a simple and convenient means to print correspondence addresses on mailing envelopes.

A typical stand-alone word processing station comprises a personal computer, a keyboard, a video display device, and a printer. The printer may take any of a variety of forms. In most cases, daisy wheel printers, dot matrix printers, ink jet printers, or laser printers are used. While most such printers can be used to print envelopes, only the more expensive versions of these printers are capable of handling the printing of addresses on envelopes satisfactorily.

With daisy wheel and dot matrix printers, and with some of the ink jet printers, it is necessary to insert envelopes manually behind a typewriter-type platen and to roll the platen until the envelope wraps around it and moves to the appropriate printing position. Automatic envelope loading devices are available, but they are generally expensive, and some are unreliable. The more expensive printers which are capable of handling envelopes satisfactorily are often shared by two or more word processing stations. It is inconvenient to use a shared printer for printing envelopes.

Larger mailing envelopes are ordinarily addressed by means of labels, usually labels of the kind having a pressure-sensitive adhesive layer protected by a peelable release liner. It is inconvenient to print addresses on these labels using daisy wheel, dot matrix and ink jet printers, and many problems arise in connection with attempts to print such labels using laser printers.

As a result of the difficulties encountered in using conventional word processing printers for printing addresses, it is a common practice to provide a conventional typewriter as an adjunct to a word processing station primarily for the purpose of addressing envelopes and labels.

The principal object of this invention is to provide an inexpensive printing device, capable of being driven by a dedicated word processor or personal computer, for printing addresses on mailing envelopes. It is also an object of the invention to provide an envelope printing device which is capable of handling envelopes in a wide range of sizes. Other objects of the invention include compactness, reliability, simplicity and ease of use.

The envelope printing mechanism in accordance with the invention comprises a platen and printing means movable relative to the platen for printing characters in sequentially printed lines on an envelope, and means for effecting line feed movement of the envelope following printing of each line.

One version of the printing mechanism utilizes a number of essentially conventional components including a roller platen, and a print head located adjacent to the platen for printing characters along a printing line on an envelope located between the print head and the platen. A first drive effects relative movement of the print head and platen along a direction parallel to the platen's axis of rotation. Rollers or other suitable pressure devices are provided to hold an envelope against the platen. A second drive effects line feed rotation of the platen. In another version, the platen takes the form of a flat surface arranged so that the envelope can be inserted between the print head and the flat surface. Line feeding movement of the envelope during printing is effected by a driven roller remote from the location of the print head. The roller causes the envelope to slide on the flat platen surface.

An important feature which distinguishes the printing mechanism of the invention from a conventional printer is the fact that the elements of the printing mechanism are constructed and arranged to provide a clearance permitting an envelope to remain entirely in a flat condition while the envelope is being printed. This arrangement greatly simplifies envelope insertion, and permits printing on envelopes of any size.

To accommodate envelopes of large size, and also to facilitate positioning of an envelope so that printing takes place in the desired area on its face, the housing containing the platen, print head and drives is constructed with specially configured slots. First and second opposite end walls of the housing, and a third wall extending from one end wall to the other, provide at least partial coverage of the print head and platen. The third wall has a slot extending from one end wall to the other, the slot being arranged to receive an envelope and to allow the envelope to be inserted in a flat condition between the print head and the platen. The end walls have parallel slots, meeting and continuous with the slot of the third wall. The parallel slots of the end walls are aligned with a plane which is tangent to the platen at the location of the printing line, so that the envelope being printed can extend outwardly from the housing through all three slots.

The printing mechanism can be provided with a vertical slot for downward envelope insertion or with a horizontal slot. In the case of a horizontal slot the printing mechanism is preferably designed to receive the envelope top first, and to print the lines of the address in reverse order. A printing unit can be made convertible for horizontal or vertical slot operation.

Further objects and advantages of the invention will be apparent from the following detailed description, when read in conjunction with the drawings.

DETAILED DESCRIPTION

Figure 1:
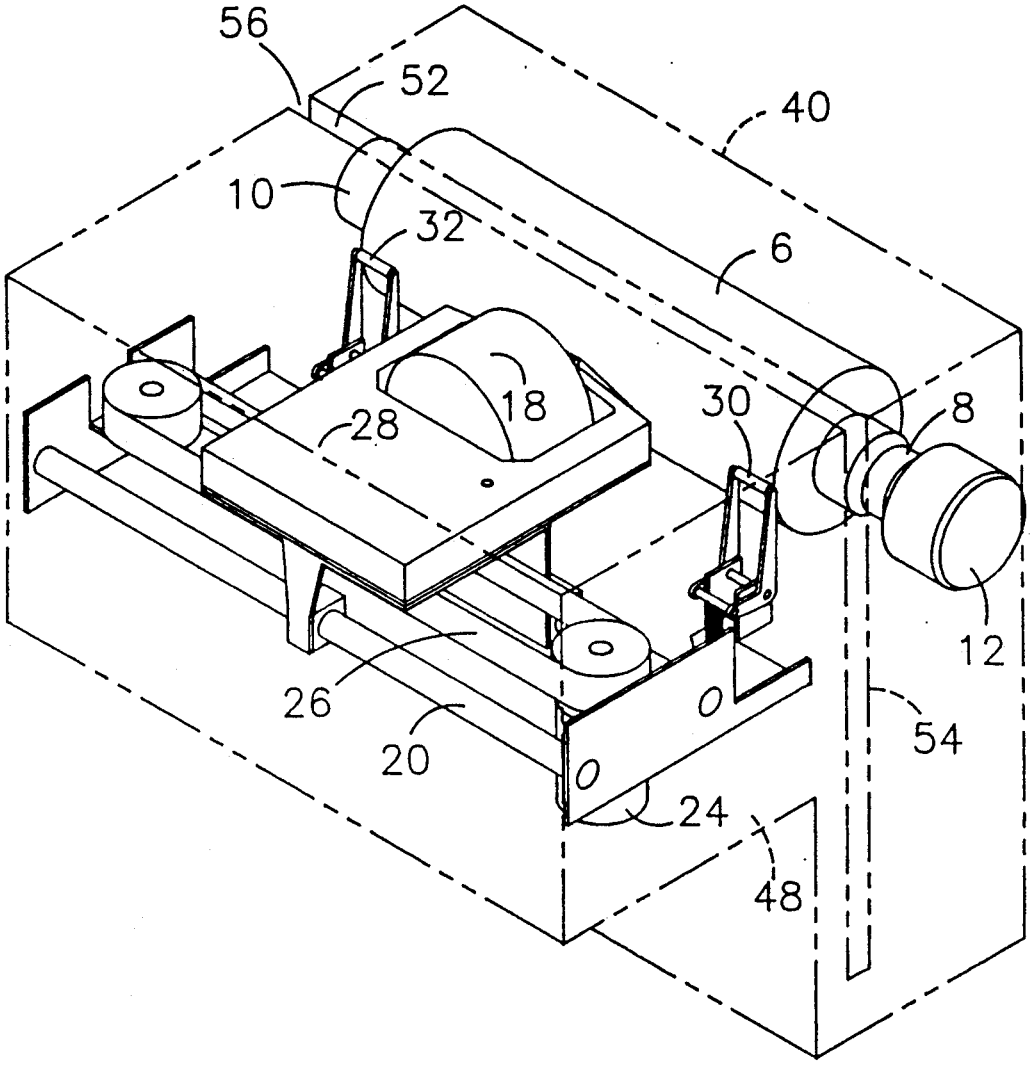
FIG. 1 is an isometric view of one embodiment of a printing mechanism in accordance with the invention, showing the printer housing and envelope-receiving slots in broken lines.
Figure 2:
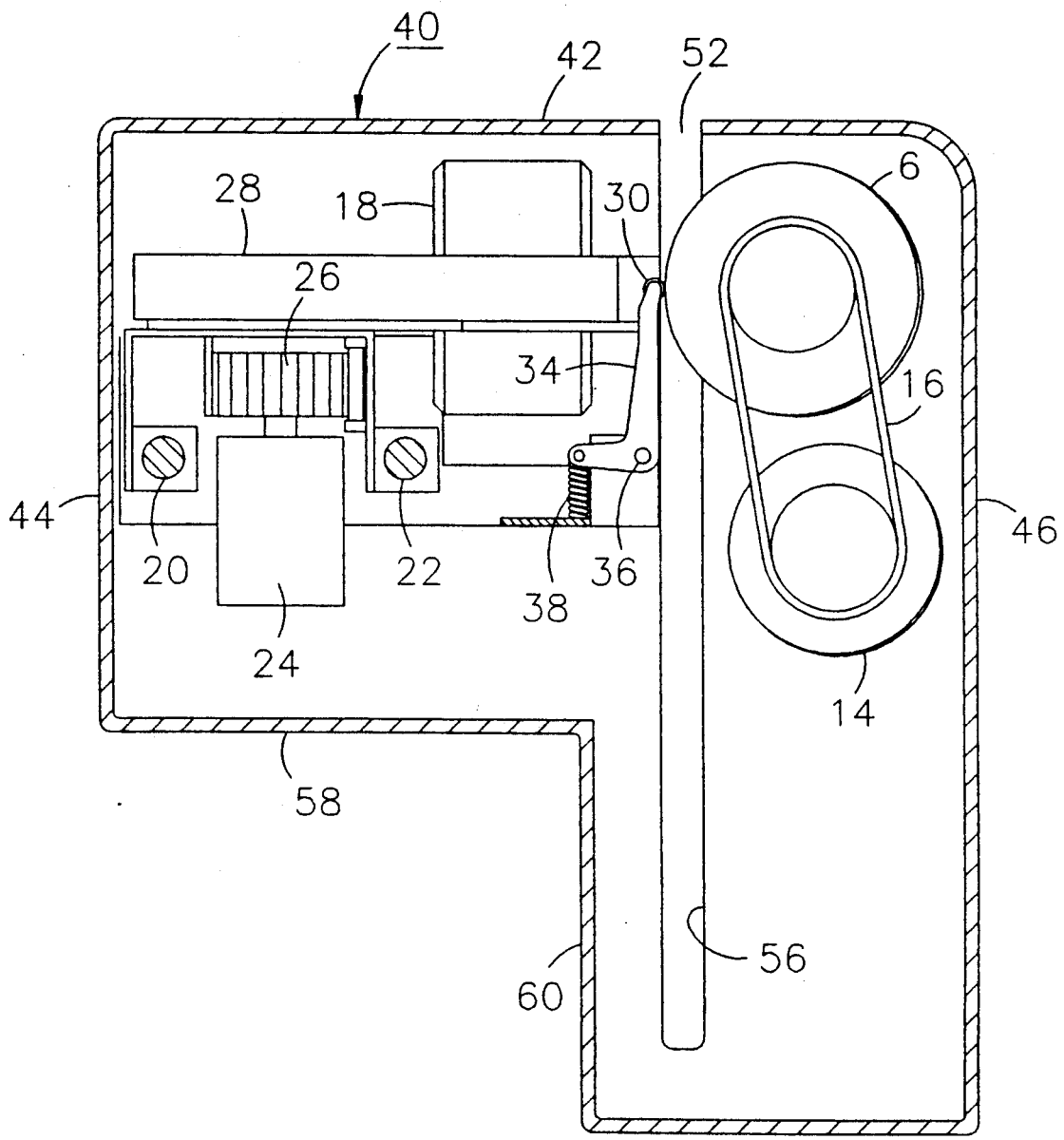
FIG. 2 is a vertical section of the printing mechanism.

Referring to FIG. 1, which shows a preferred embodiment of the invention, the printing mechanism comprises a cylindrical roller platen 6 arranged to rotate on a horizontal axis in bearings 8 and 10. A knob 12 is provided for manual rotation of the platen. The diameter of the platen can be smaller than that of a conventional printer or typewriter platen, as there is no need to wrap stationery around the platen. Thus, the diameter of the platen can be as little as one inch or even less. Its length does not need to be any greater than the maximum length of a printed address, and can be as little as 4½ inches. A platen drive motor 14, which may be a stepping motor, is shown in FIG. 2. It drives platen 6 through a drive belt 16.

A print head 18, for example a conventional 24-pin dot matrix print head, is arranged to move along the platen in a direction parallel to the platen axis, being guided along horizontal bars 20 and 22. The print head is driven by a second stepping motor 24 through a belt 26. A ribbon cartridge 28 is carried along with the print head 18.

A pair of rollers 30 and 32 are arranged in pivoting frames and urged by compression springs against the surface of platen 6 adjacent to both ends of the platen. As shown in FIG. 2, roller 30 is held in frame 34, which is pivoted on pin 36 and urged clockwise by compression spring 38 so that the roller is pressed against the platen. The frame and spring holding roller 32 against the platen are similar. The purpose of these rollers is to hold an envelope against the platen so that platen rotation frictionally feeds the envelope outwardly as printing progresses. The rollers are preferably aligned with the printing line.

Figure 3:
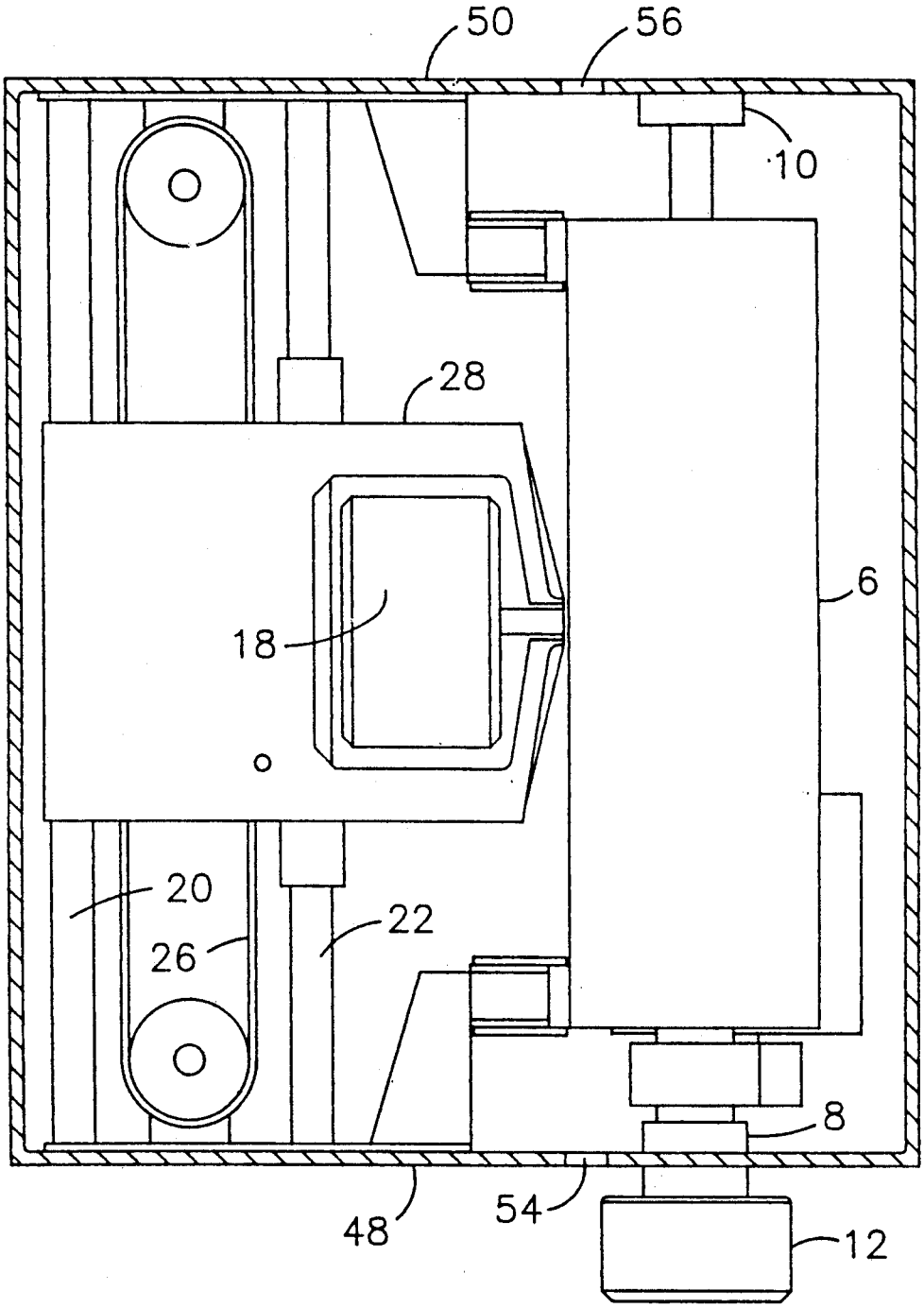
FIG. 3 is a horizontal section in which the printing mechanism is viewed from above.
Figure 4:
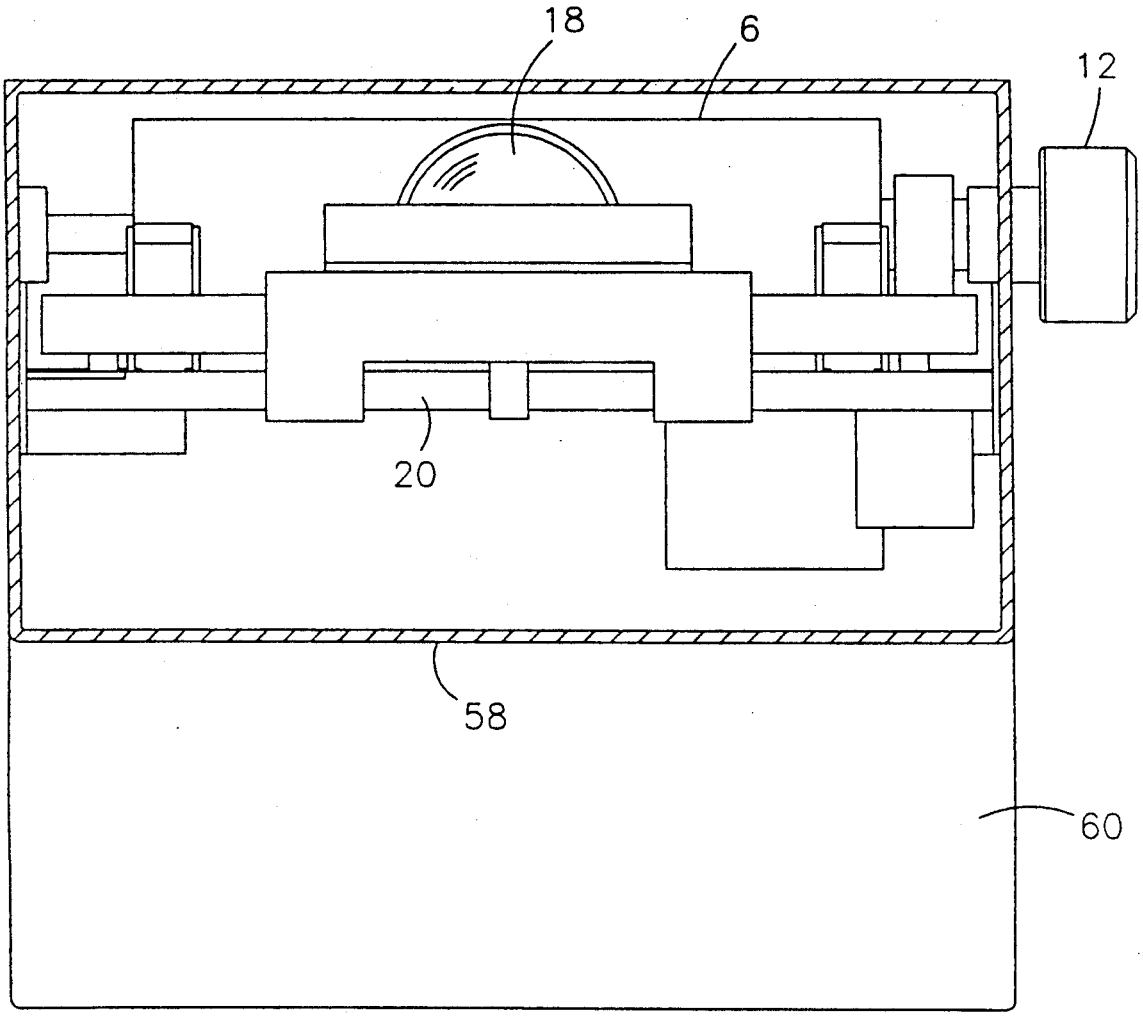
FIG. 4 is a vertical section in which the printing mechanism is viewed from the rear.

The platen, print head and drive mechanism are enclosed in a housing 40. The housing has a top wall 42, and front and rear walls 44 and 46, as shown in FIG. 2. It also has side walls 48 and 50, as shown in FIG. 3.

The top wall 42 has a slot 52 extending parallel to the axis of the platen and located directly above the location at which printing takes place. Slot 52 extends from one side wall to the other, and is continuous with vertical slots 54 and 56 formed in the side walls. This allows the printer mechanism to accommodate even the largest envelopes. Slots 54 and 56 in the side walls extend well below the level at which printing takes place, so that addresses can be printed on large envelopes at the appropriate locations. As seen in FIG. 2, the elements of the printing mechanism are arranged to provide a clearance below the printing location, allowing envelopes to be situated in a flat condition while being printed.

Because of the length requirements for slots 54 and 56, it is desirable to shape the housing 40, as shown in FIG. 2, with a bottom wall 58 below the print head drive mechanism, and a rear section 60 extending downward below the level of bottom wall 58. The housing can be positioned with bottom wall 58 resting on the edge of a table and section 60 extending downward below the level of the table. This reduces the overall height of the printer and makes it easier to insert envelopes into slot 52, while allowing the printer to accommodate large envelopes.

To use the printer to address an envelope, the operator inserts the envelope between the platen and print head until it reaches a position in which the print head is adjacent to the point on the envelope at which printing is to begin. The envelope is inserted between the platen and rollers 30 and 32, and can be manually pushed downward to the desired position. Platen drive motor 14 is not energized except when printing or line feeding is taking place, and, when not energized, allows the platen to rotate counterclockwise (as viewed in FIG. 2) when the envelope is pushed downward. During insertion, the envelope can alternatively be moved downward by counterclockwise rotation of the platen control knob 12.

The address to be printed on the envelope can be derived from a list in a computer memory, or entered manually into the word processor separately from the correspondence being mailed, or derived from the inside address on the correspondence by means of suitable word processing software. In any case, the address data is directed to the printer, which then prints the address on the envelope, indexing the envelope outwardly each time it receives a line feed code. When printing is complete, the envelope can be ejected automatically by platen rotation, or it can be removed from the printer manually.

The principal advantage of the arrangement allowing the envelope to remain in a flat condition is that it is easy to insert the envelope manually, and unnecessary to wrap it around a platen. This makes it possible to print on large, e.g. 9"×12"or 10"×15", envelopes. If mailing labels are desired, they can be attached to the large envelopes before printing. The envelopes can easily be positioned in the printer so that printing takes place on the labels.

Figure 5:
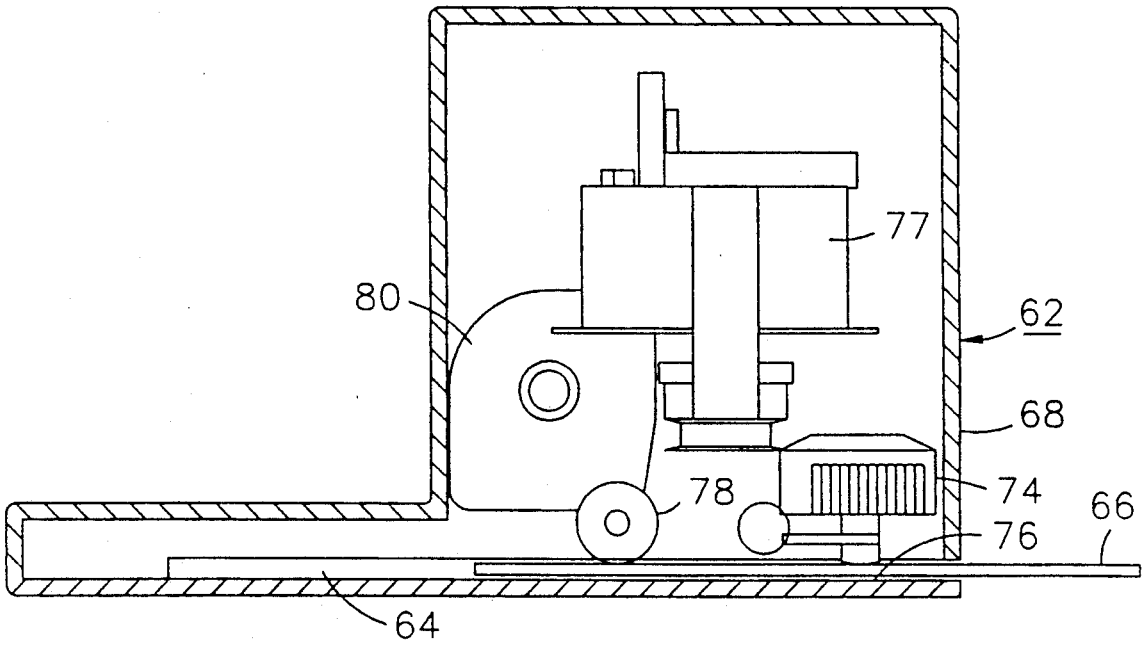
FIG. 5 is a side view in vertical section of an alternative embodiment of the invention using a flat platen at the print head location and an envelope feeding roller spaced from the print head.
Figure 6:
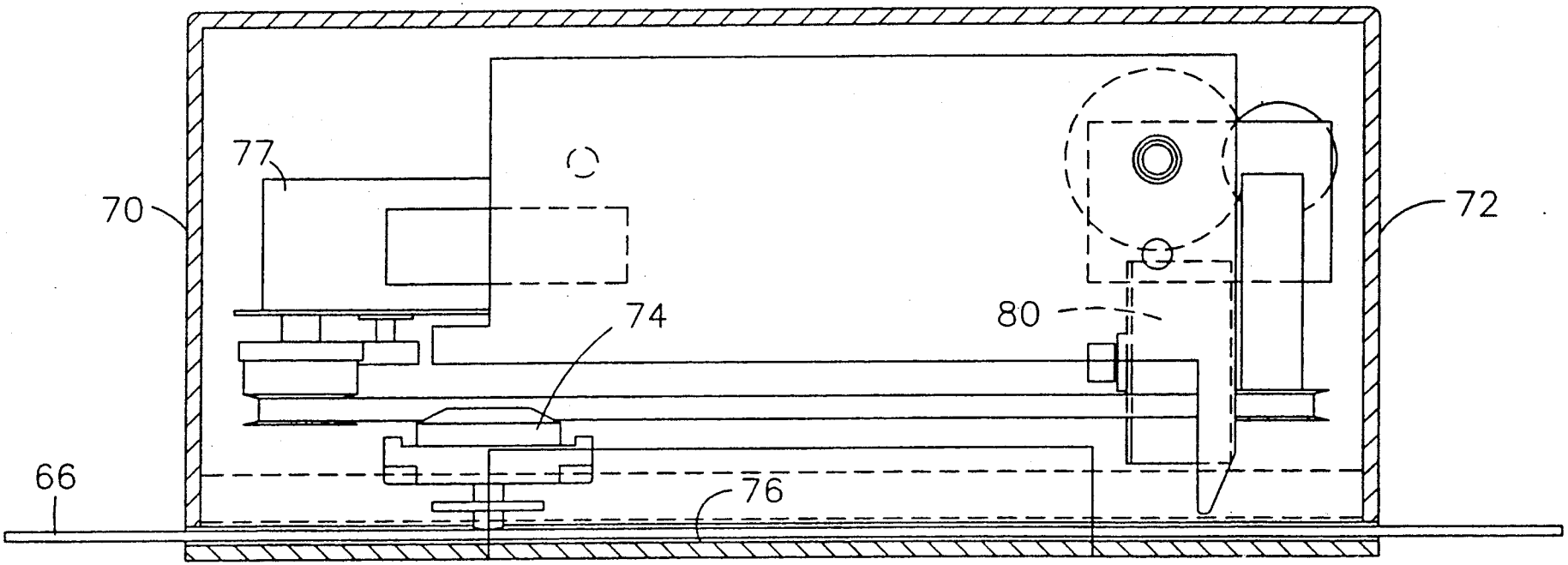
FIG. 6 is a front view in vertical section of the embodiment of FIG. 5.

In the embodiment shown in FIGS. 5 and 6, the housing 62 has a slot in its front wall 68 and slots in its sidewalls, together providing a horizontally extending clearance 64 for receiving an envelope 66. The envelope is inserted through the slot opening in front wall 68, and may extend outwardly through either or both of the side walls 70 and 72 as shown in FIG. 6. A dot matrix print head 74, is driven by motor 77 for lateral movement across the surface of the envelope in a direction parallel to front wall 68. A surface 76 underneath the envelope serves as a platen. It provides a firm backing for the envelope, allowing the print head pins to operate effectively, and also allows the envelope to slide inwardly during envelope insertion, and outwardly as the envelope is fed mechanically during line feed motion of the printing mechanism.

Line feed motion is effected by a friction roller 78, which is driven by a motor drive mechanism 80. The drive mechanism for roller 78 is preferably similar to the drive mechanism for the roller platen in FIGS. 1-4 in that it is designed to permit free rotation of the roller except during printing and line feeding. In this way, it is possible for an envelope to be inserted manually into position between roller 78 and platen surface 76 without the need for manual release of the roller.

In operation of the printing mechanism of FIGS. 5 and 6, the envelope is inserted into the slot until the location of the first line of printing is underneath the print head. Roller 78 indexes the envelope outwardly after each line is printed, and the envelope can be removed manually when printing is complete.

In FIG. 5, the envelope can be inserted bottom-first into the slot so that the flap opening of the envelope extends outward from the slot opening in front wall 68. However, bottom-first envelope insertion is unnatural, and therefore undesirable, when the slot is horizontal. To permit top-first envelope insertion, the printer driving software or firmware can provide a buffer allowing the address lines to be printed in reverse order, with the bottom line of the address printed first, and the top line printed last.

The printer driving software or firmware may be provided with a special character set so that the print head can be made to print characters right-side up or upside down. This allows the printing mechanism of FIGS. 5 and 6 to be positioned as shown for top first horizontal envelope insertion or rotated so that its slot is vertical for bottom-first envelope insertion.

Figure 7:
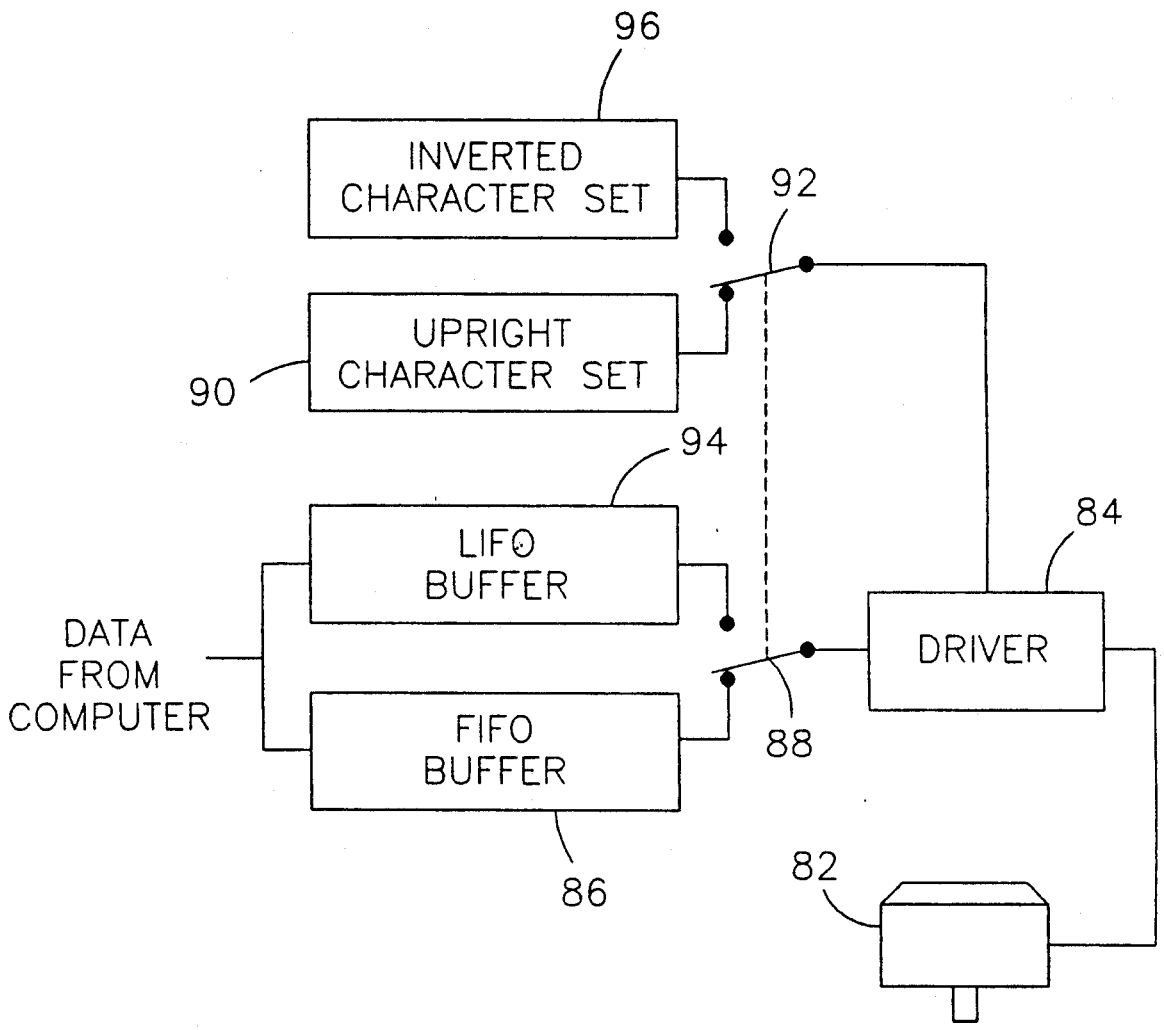
FIG. 7 is a block diagram schematically illustrating the manner in which the print head is driven.

FIG. 7 shows a print head 82 driven by a conventional print head driver 84. Data from a computer is delivered to the driver through a conventional first-in, first-out (FIFO) buffer 86 and a switch 88. A character set memory 90, which may take the form of a programmed read-only memory (PROM), is connected to driver 84 to establish a conventional upright character set. The connection is through a switch array represented by switch 92.

The driving electronics as described above is used when the envelope printer is used to print on envelopes inserted bottom first. However, when the slot is horizontal, and the envelopes are inserted top first, switches 88 and 92 are thrown in order to utilize a last-in, first-out (LIFO) character buffer 94, and an inverted character set memory 96. This allows the same print head 82 to be used either to print in the conventional manner, or to print characters upside-down and in reverse order.

Many modifications can be made to the printing mechanisms described. For example, in the version of FIGS. 1-4, where the overall height of the printer is not a problem, bottom wall 58 can be located below the level of the lower ends of the slots in the side walls. The housing 62 in FIGS. 5 and 6 can be similarly modified. The printer housing can be provided in a version in which one of the side wall slots, e.g. slot 54 or 56 in FIGs. 1-4, is eliminated. Inverted character generation can be accomplished by means of software rather than a character memory chip, and selectable character reversal can be accomplished by reinterpreting conventionally generated characters. Other modifications will occur to persons skilled in the art, and can be made to the apparatus described without departing from the scope of the invention as defined in the following claims.

I claim:

1. A printing mechanism for envelopes and the like, comprising:

a platen;

printing means comprising a print head located adjacent to the platen with sufficient clearance for effecting printing of characters along a printing line on the envelope inserted top first or bottom first entirely within a plane located between the print head and the platen;

first drive means for effecting print head movement in one direction relative to said platen with printing of each character;

second drive means for effecting envelope movement in one direction with printing of each line;

a housing containing the platen, printing means and drive means, the housing having first and second opposite end walls, a third wall extending from one end wall to the other and providing at least partial coverage of the print head and platen, and a fourth wall in a plane parallel to the third wall on the opposite side of the housing therefrom and adapted to rest on a horizontal surface for supporting the housing;

a slot in said third wall arranged to receive the envelope and to allow the envelope to be inserted in a flat condition between the print head and the platen;

a slot in one of the end walls meeting and continuous with the slot of the third wall and aligned with a plane tangent to the platen at the location of the printing line while the envelope is being printed by the print head, whereby the envelope being printed can extend outwardly from the housing through both slots;

said one of the end walls and the slot therein extending perpendicular to the third and fourth wall in a direction away from said third wall;

characterized by the fact that the elements of the printing mechanism are constructed and arranged to provide a clearance permitting an envelope to remain entirely in the flat condition in said plane tangent to the platen;

data buffer means for receiving the characters of an address to be printed, said data buffer means being selectably operable in a first-in, first-out sequence or in a last-in, first-out sequence;

means establishing two alternatively selectable character sets;

print head driving means, for receiving data from the data buffer means, the print head driving means being responsive to the character set-establishing means, and to said data buffer means, for printing characters on the envelope; and switching means, controlling said character set establishing means and said data buffer means, for selecting one of said character sets and for selecting either a first-in, first-out sequence or a last-in, first-out sequence in said data buffer means;

whereby characters can be printed in a first-in, first-out sequence in one of said character sets, and alternatively in a last-in, first-out sequence in the other of said character sets.

2. A printing mechanism according to claim 1 in which one of said alternatively selectable character sets is a set of upright characters, and the other of said sets is a set of inverted characters; and in which said switching means is operable to select simultaneously said set of upright characters and said first-in, first-out sequence in said data buffer means, or alternatively said set of inverted characters and said last-in, first-out sequence in said data buffer means; whereby, when the envelope is inserted bottom first the set of upright characters can be printed in a first-in, first-out sequence, and when the envelope is inserted top first, the set of inverted characters can be printed in a last-in, first-out sequence.

3. A printing mechanism according to claim 2 wherein the relative arrangement of the characters in either sequence is the same.

4. An envelope printing mechanism comprising:

a platen;

printing means including a print head located adjacent to the platen for effecting printing of characters along a printing line on an envelope located between the print head and the platen;

first drive means for effecting relative movement of the print head and platen;

second drive means for effecting line feed movement of the envelope;

a housing containing the platen, printing means and drive means, the housing having first and second opposite end walls, a third wall extending from one end wall to the other and providing at least partial coverage of the print head and platen, and a fourth wall in a plane parallel to the third wall on the opposite side of the housing therefrom and adapted to rest on a horizontal surface for supporting the housing;

a slot in said third wall arranged to receive the envelope and to allow the envelope to be inserted in a flat condition between the print head and the platen;

a slot in one of the end walls meeting and continuous with the slot of the third wall and aligned with a plane tangent to the platen at the location of the printing line while the envelope is being printed by the print head, whereby the envelope being printed can extend outwardly from the housing through both slots;

said one of the end walls and the slot therein extending perpendicular to the third and fourth walls and beyond the plane of said fourth wall in a direction away from said third wall; and characterized by the fact that the elements of the printing mechanism are constructed and arranged to provide a clearance permitting an envelope to remain entirely in the flat condition in said plane tangent to the platen.

5. An envelope printing mechanism according to claim 4 in which the elements of the printing mechanism are constructed and arranged so that said plane tangent to the platen at the location of the printing line is vertical.

6. An envelope printing mechanism comprising:

a roller platen having an axis of rotation;

printing means comprising a print head located adjacent to the platen for effecting printing of characters along a printing line on an envelope located between the print head and the platen;

first drive means for effecting relative movement of the print head and platen along a direction parallel to the platen's axis of rotation;

means for holding an envelope against the platen;

second drive means for effecting line feed rotation of the platen;

a housing containing the platen, printing means and drive means, the housing having first and second opposite end walls, a third wall extending from one end wall to the other and providing at least partial coverage of the print head and platen, and a fourth wall in a plane parallel to the third wall on the opposite side of the housing therefrom and adapted to rest on a horizontal surface for supporting the housing;

a slot in said third wall arranged to receive the envelope and to allow the envelope to be inserted in a flat condition between the print head and the platen; a slot in one of the end walls meeting and continuous with the slot of the third wall and aligned with a plane tangent to the platen at the location of the printing line while the envelope is being printed by the print-head, whereby the envelope being printed can extend outwardly from the housing through both slots;

said one of the end walls and the slot therein extending perpendicular to the third and fourth walls and beyond the plane of said fourth wall in a direction away from said third wall; and characterized by the fact that the elements of the printing mechanism are constructed and arranged to provide a clearance permitting the envelope to remain entirely in the flat condition.

7. An envelope printing mechanism according to claim 6 wherein said end walls are arranged so that the platen's axis extends through both end walls; and said slot in said third wall extends parallel to the platen's axis.

8. An envelope printing mechanism according to claim 6 wherein said end walls are arranged so that the platen's axis extends through both end walls; wherein the slot in the third wall extends parallel to the platen's axis from one end wall to the other; and wherein the other of the end walls has a slot meeting and continuous with the slot of the third wall, the slots of the end walls being parallel to each other and aligned with said plane tangent to the platen, whereby an envelope being printed can extend outwardly from the housing through all three slots.

* * * * *